US006622619B1

(12) United States Patent
Liu et al.

(10) Patent No.: US 6,622,619 B1
(45) Date of Patent: Sep. 23, 2003

(54) ROD-ACTUATING STRAP CONTROL DEVICE FOR A STRAPPING MACHINE

(75) Inventors: Chin-Chang Liu, Taichung (TW); Chi-jan Su, Taipei (TW)

(73) Assignee: Tekpak Corporation, Taichung (TW)

( * ) Notice: Subject to any disclaimer, the term of this patent is extended or adjusted under 35 U.S.C. 154(b) by 0 days.

(21) Appl. No.: 10/215,332

(22) Filed: Aug. 9, 2002

(51) Int. Cl.[7] ..... G05D 15/00; B65B 13/04; B65H 43/08; B65H 77/00

(52) U.S. Cl. ..... 100/4; 100/26; 53/589; 226/26; 226/118.4; 242/418.1

(58) Field of Search ..... 100/4, 8, 26, 29, 100/32; 53/67, 74, 494, 589; 226/118.2, 26, 118.4; 242/364.7, 420.6, 564.3, 418.1

(56) References Cited

U.S. PATENT DOCUMENTS 2,792,615 A * 5/1957 Cohn et al. ..... 26/18.5
2,797,086 A * 6/1957 Cohn et al. ..... 226/26
3,137,426 A * 6/1964 Brenneisen ..... 226/10
3,890,547 A * 6/1975 Keck ..... 318/6
4,015,452 A * 4/1977 Kreitz ..... 68/175
4,440,003 A * 4/1984 Koch ..... 68/22 R
5,079,899 A * 1/1992 Kurachi ..... 53/399
6,038,967 A * 3/2000 Chak et al. ..... 100/2

* cited by examiner

*Primary Examiner*—William Hong
*Assistant Examiner*—Jimmy Nguyen
(74) *Attorney, Agent, or Firm*—Troxell Law Office PLLC

(57) ABSTRACT

A rod-actuating strap control device for a strapping machine includes a rod-interacting unit composed of an actuating rod and a weight rod assembled on a rotary member and the relative action produced between the rod-interacting unit and a press rod as well as the balanced rod with cooperation of the sensing function between a sensing switch and the actuating rod to effectively control the length or amount of the packaging strap stored in a strap reserving room. The operation between the actuating rod of rod-interacting unit and the weight rod is based on a lever structure, therefore no tiredness of resilience or damage of a twisting spring may happen to them, able to prolong the service life of the machine and control the length or amount of packaging strap stored in a strap reserving room with great precision and stability.

4 Claims, 10 Drawing Sheets

ROD-ACTUATING STRAP CONTROL DEVICE FOR A STRAPPING MACHINE

BACKGROUND OF THE INVENTION

This invention relates a rod-actuating strap control device for a strapping machine, particularly to one capable of adjusting and controlling the length or weight of packaging strap stored in a strap reserving room with quickness and stability.

Generally, a strapping machine has a strap control device provided for the strap reserving room in controlling a packaging strap of a present length to be stored in a strap reserving room and guided out for strapping an article to be strapped.

A conventional control device 10 for controlling a strap reserving length or weight, as shown in FIGS. 1 and 2, includes a balanced rod 11 and a press rod 12 fixed respectively on the opposite ends of a rotating shaft 13, which is inserted through the separating plate 21 of a strap reserving room and through a shaft sleeve 14 secured on the outer side of the separating plate 21, letting the balanced rod 11 and press rod 12 positioned respectively at the inner and the outer side of the separating plate 21. The shaft sleeve 14 is fitted around with a fixing base 15 having a support frame 151 extending outward horizontally. The support frame 151 is fixed with a micro-switch 16 on one side, and a twisting spring 17 and a stop rod 18 on the front side 152. The twisting spring 17 has its lower end extending downward to make up a hook 171 positioned beneath the bottom edge of the support frame 151 and its upper end extending horizontally to form a blocking member 172 a little above the stop rod 18, with the lower edge of the end of the press rod 12 touching and pressing on the blocking member 172 to prevent the press rod 12 from pressing directly on the press button 161 of the micro-switch 16.

In operating, as shown in FIGS. 3, 4 and 5, a strap feed device 40 is first started to guide a packaging strap 30 to move along the top edge of the balanced rod 11 and get into the strap reserving room 20, with the packaging strap 30 arranged upward orderly in a mode of overlapping at the left and the right sides of the balanced rods 11 In this case, if the total weight of the packaging strap 30 guided in the strap reserving room 20 and the overlapping tension therebetween is larger than the resilience of the blocking member 172, the balanced rod 11 will be pressed to incline downward and actuate the rotating shaft 13 to rotate and make the press rod 12 incline downward synchronously. At this time, the press rod 12 has its end edge pressing on the blocking member 172 as well as on the press button 161 of the micro-switch 16, which immediately sends out a signal to turn off the power of the strap feed device 40 to stop guiding the packaging strap into the strap reserving room 20, thus finishing work of strap controlling and reserving.

On the contrary, in case the packaging strap 30 in the strap reserving room 20 is guided out for strapping articles, the gravity of packaging strap 30 on the balanced rod 11 will vanish, and the blocking member 172 will recover its resilience to push the press rod 12 to incline upward to separate from the press button 161 of the micro-switch 16. Then, the micro-switch 16 sends out a signal to turn on the power of the strap feed device 40 to start guiding the packaging strap 30 into the strap reserving room 20 for carrying out next round of strapping.

However, in the conventional control device 10, the amount of packaging strap 30 guided and stored in the strap reserving room 20 is controlled by the resilience of the twisting spring 17. Thus, when a strapping machine is in use, the blocking member 172 of the twisting spring 17 will be repeatedly pressed for a long period of time by the press rod 12, therefore the twisting spring 17 is easy to give rise to tiredness of resilience and become loose, weakened or even damaged after used for a period of time, liable to shorten the service life of the machine and impossible to stably control the length or amount of packaging strap 30 guided and stored in the strap reserving room 20.

Besides, the resilience of the twisting spring 17 is fixed, impossible to be adjusted, and the length or amount of the packaging strap 30 stored in the strap reserving room 20 is controlled by the twisting spring 17, thus failing to meet practical needs in operation.

SUMMARY OF THE INVENTION

This invention is to offer a rod-actuating strap control device for a strapping machine, able to control the amount of packaging strap stored in a strap reserving room with great stability by operating a rod-interacting unit made of an actuating rod and a weight rod separately assembled on a rotary member and by the relative action produced among the rod-interacting unit and a press rod and a balanced rod, prolonging the service life of the machine and lowering cost for maintenance and repair.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
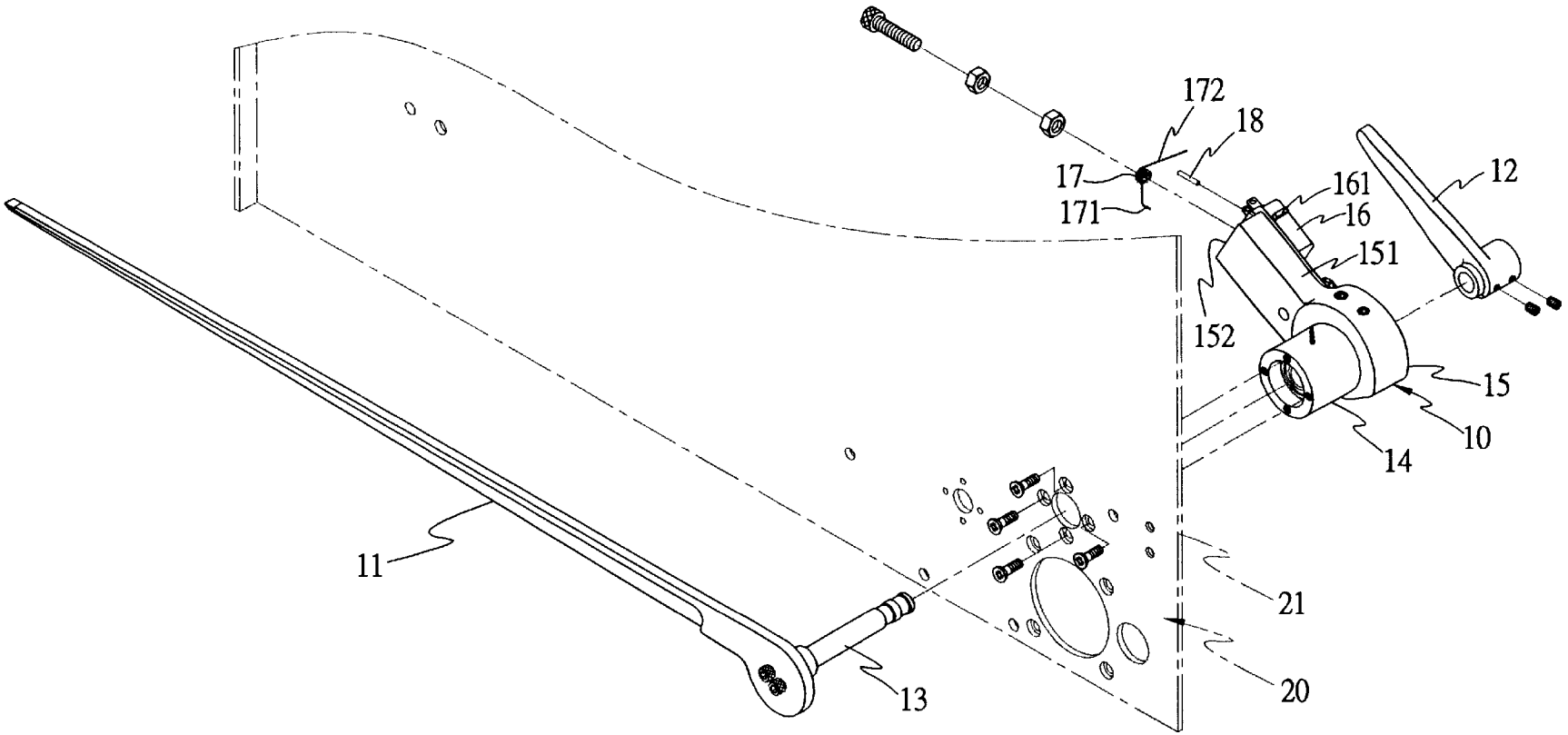
FIG. 1 PRIOR ART
FIG. 1 is an exploded perspective view of a conventional strap control device.
Figure 2:
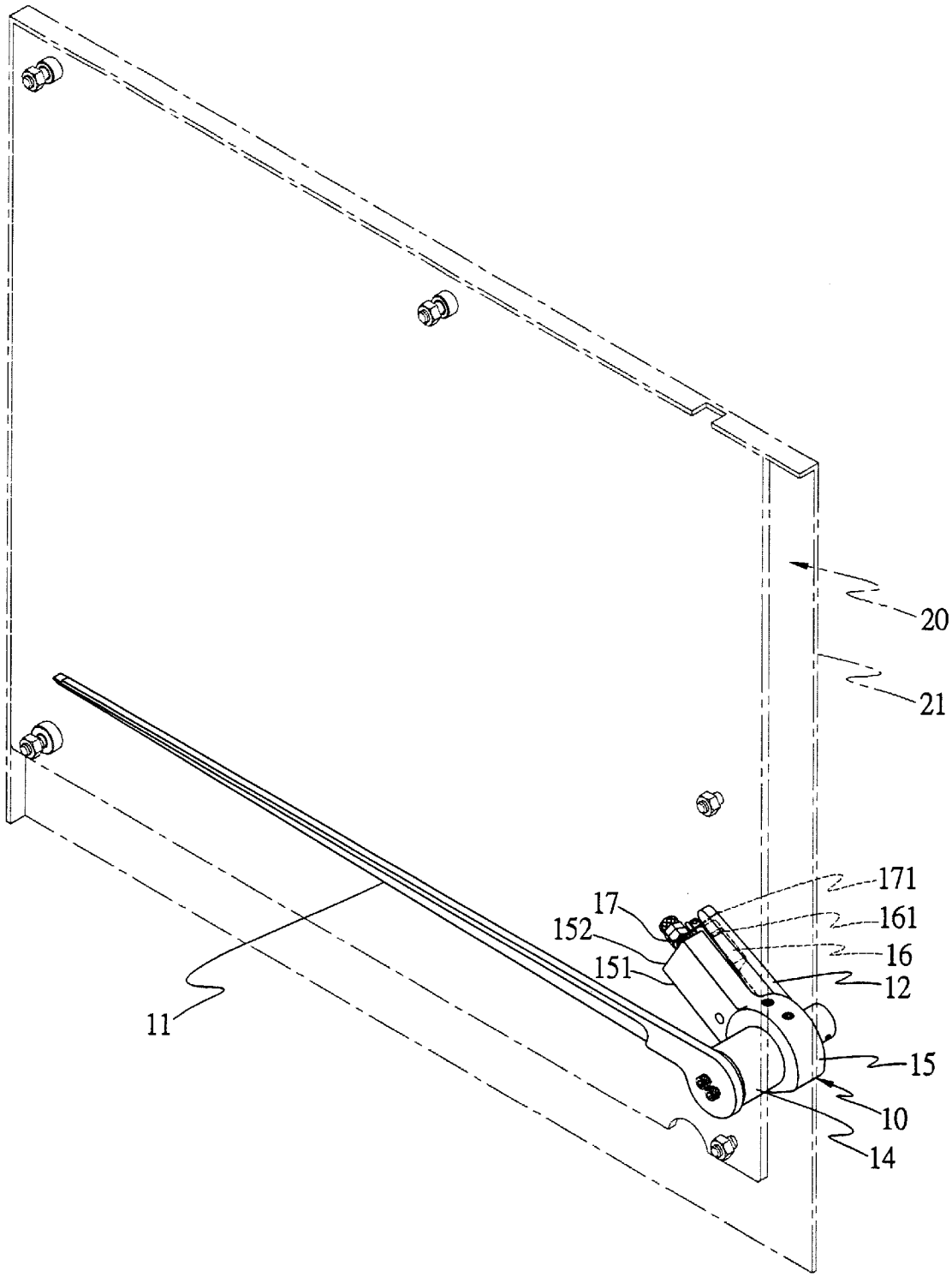
FIG. 2 PRIOR ART
FIG. 2 is a perspective view of the conventional strap control device.
Figure 3:
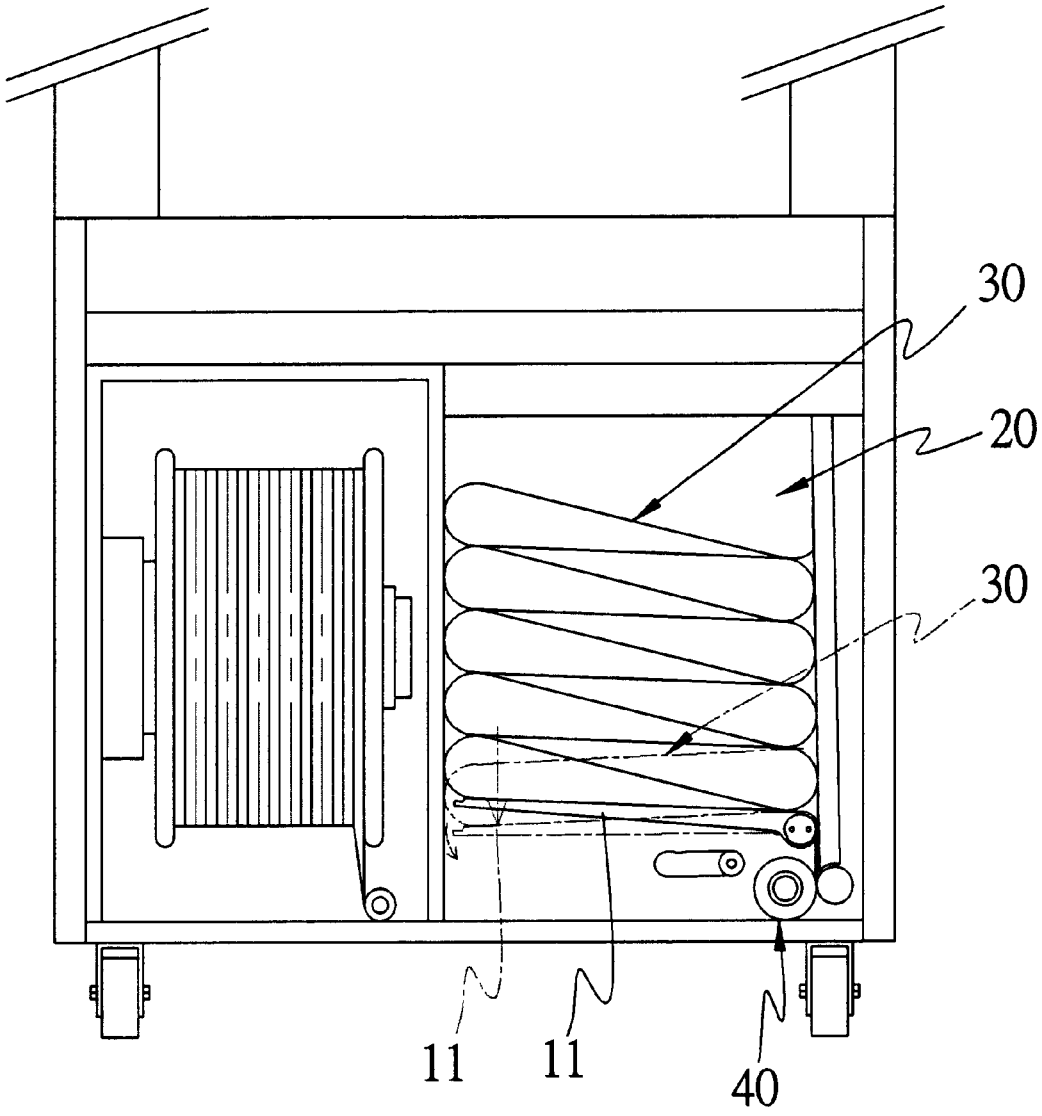
FIG. 3 PRIOR ART
FIG. 3 is a cross-sectional view of the conventional strap control device, illustrating a balanced rod pressed downward by the packaging strap stored in a strap reserving groove.
Figure 4:
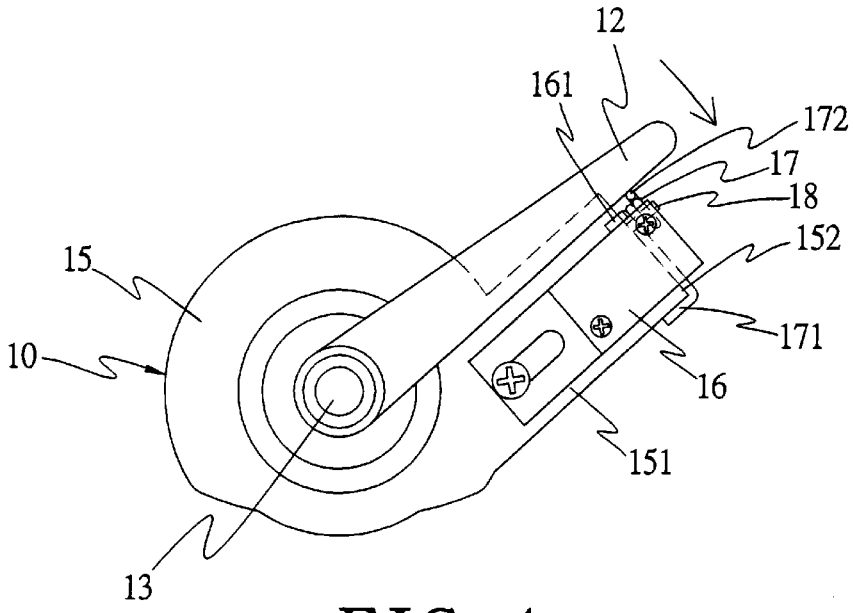
FIG. 4 PRIOR ART
FIG. 4 is a cross-sectional view of the conventional strap control device, illustrating a press rod actuated to incline downward after storing packaging strap in the strap reserving room.
Figure 5:
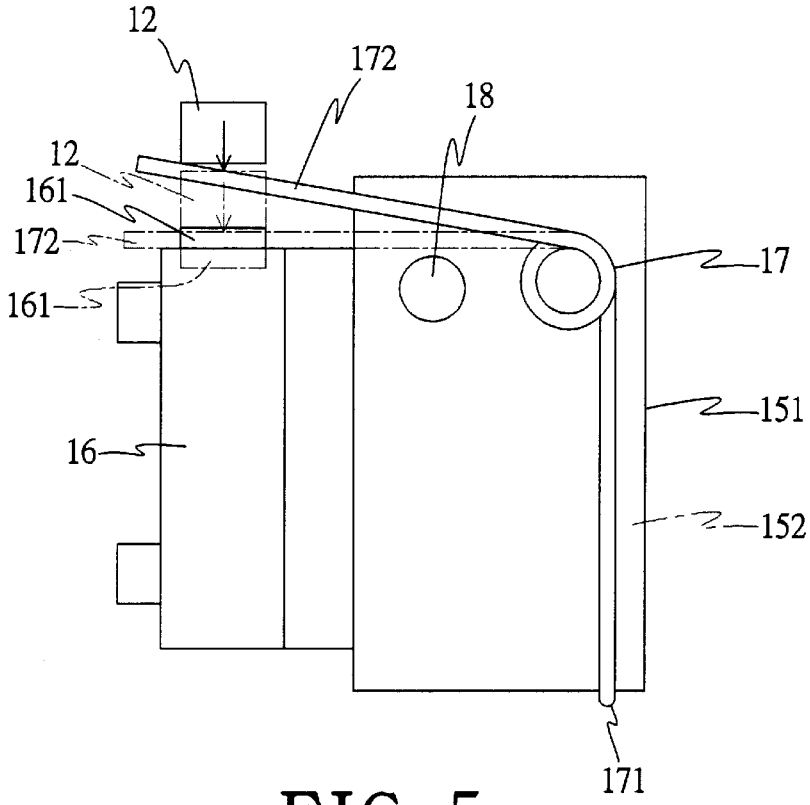
FIG. 5 PRIOR ART
FIG. 5 is a cross-sectional view of the conventional strap control device, illustrating the press rod pressing on the press button of a micro-switch.
Figure 6:
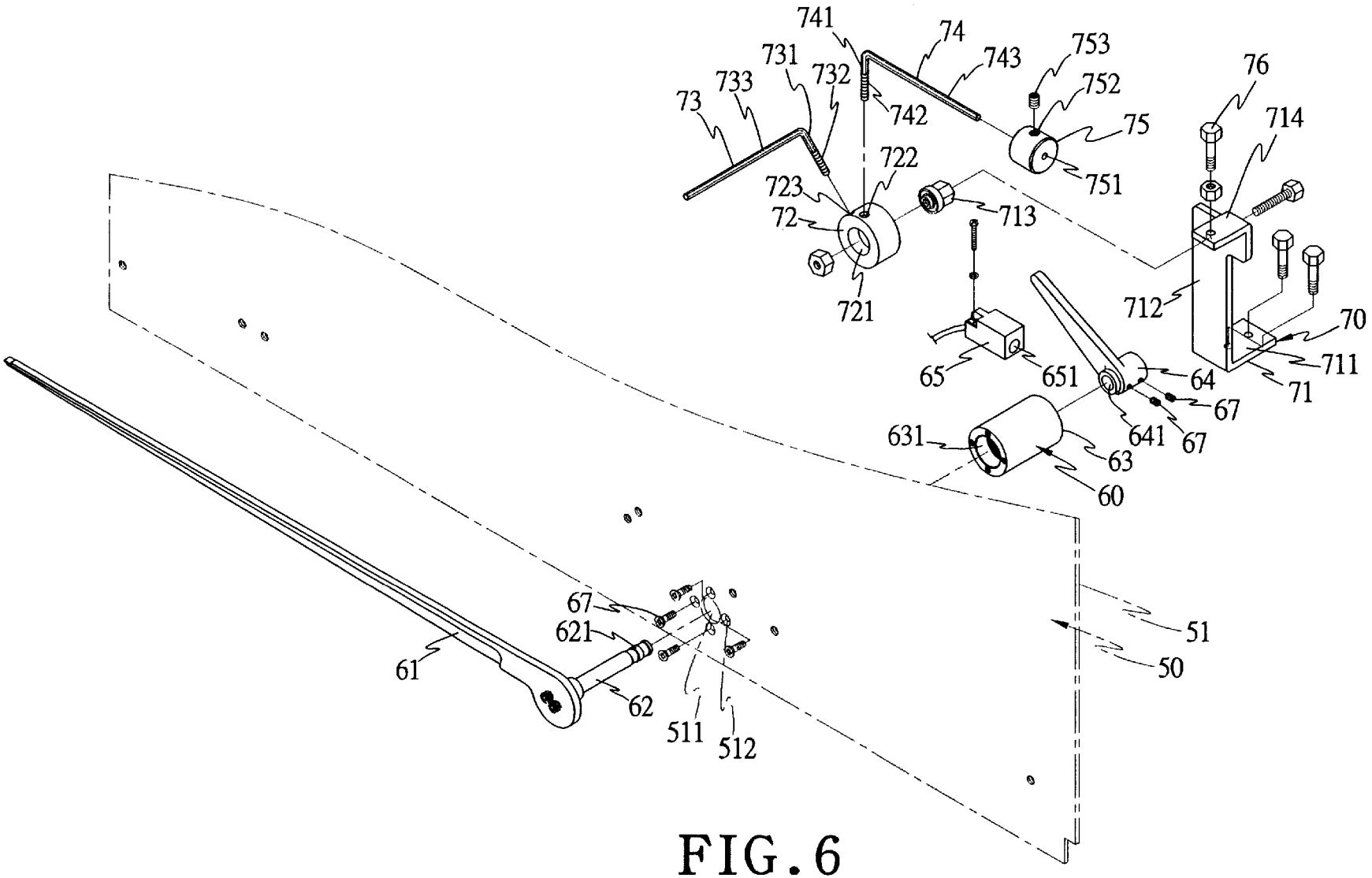
FIG. 6 is an exploded perspective view of a preferred embodiment of a rod-actuating strap control device in the present invention.
Figure 7:
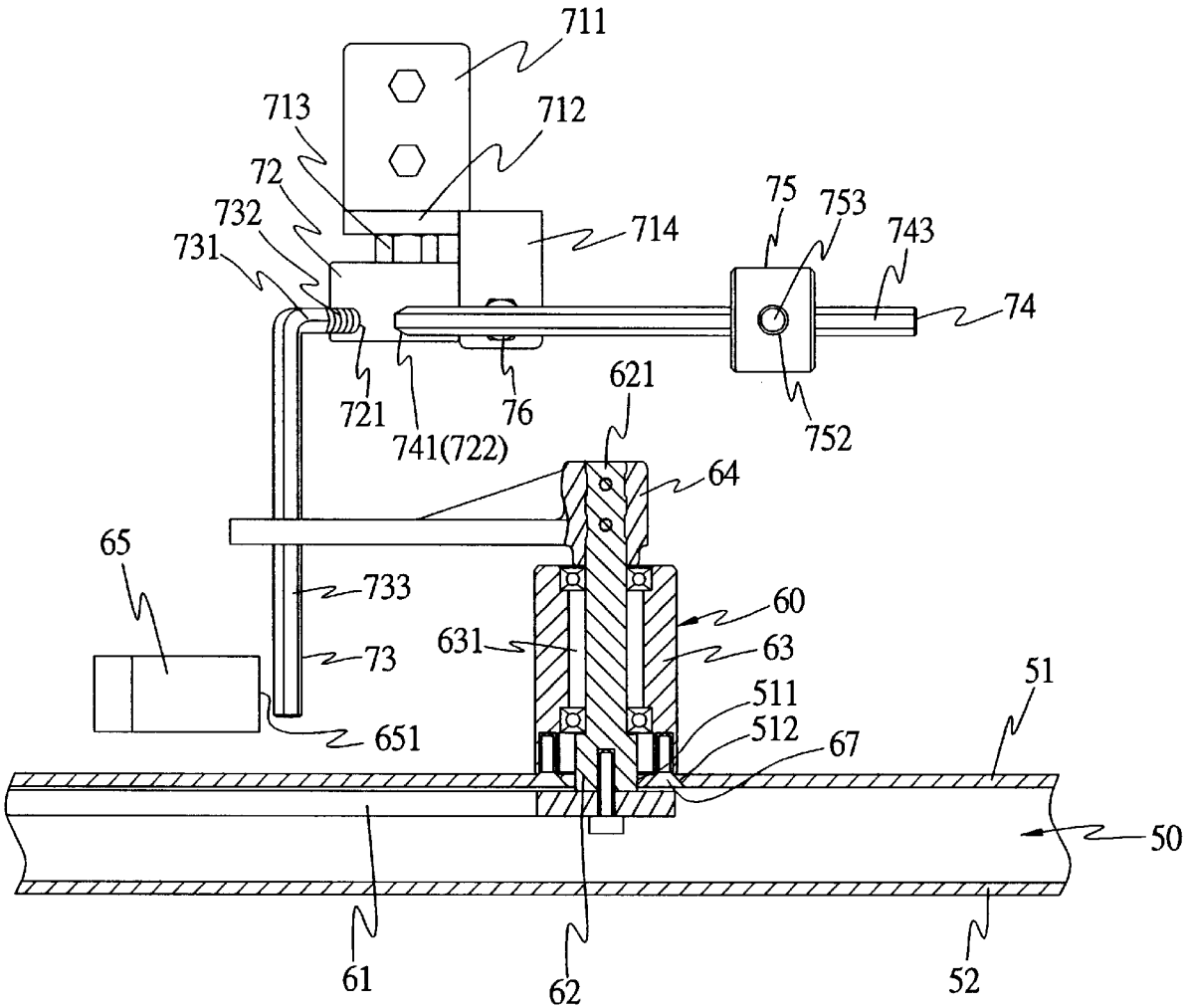
FIG. 7 is an upper view of the preferred embodiment of the rod-actuating strap control device in the present invention.
Figure 8:
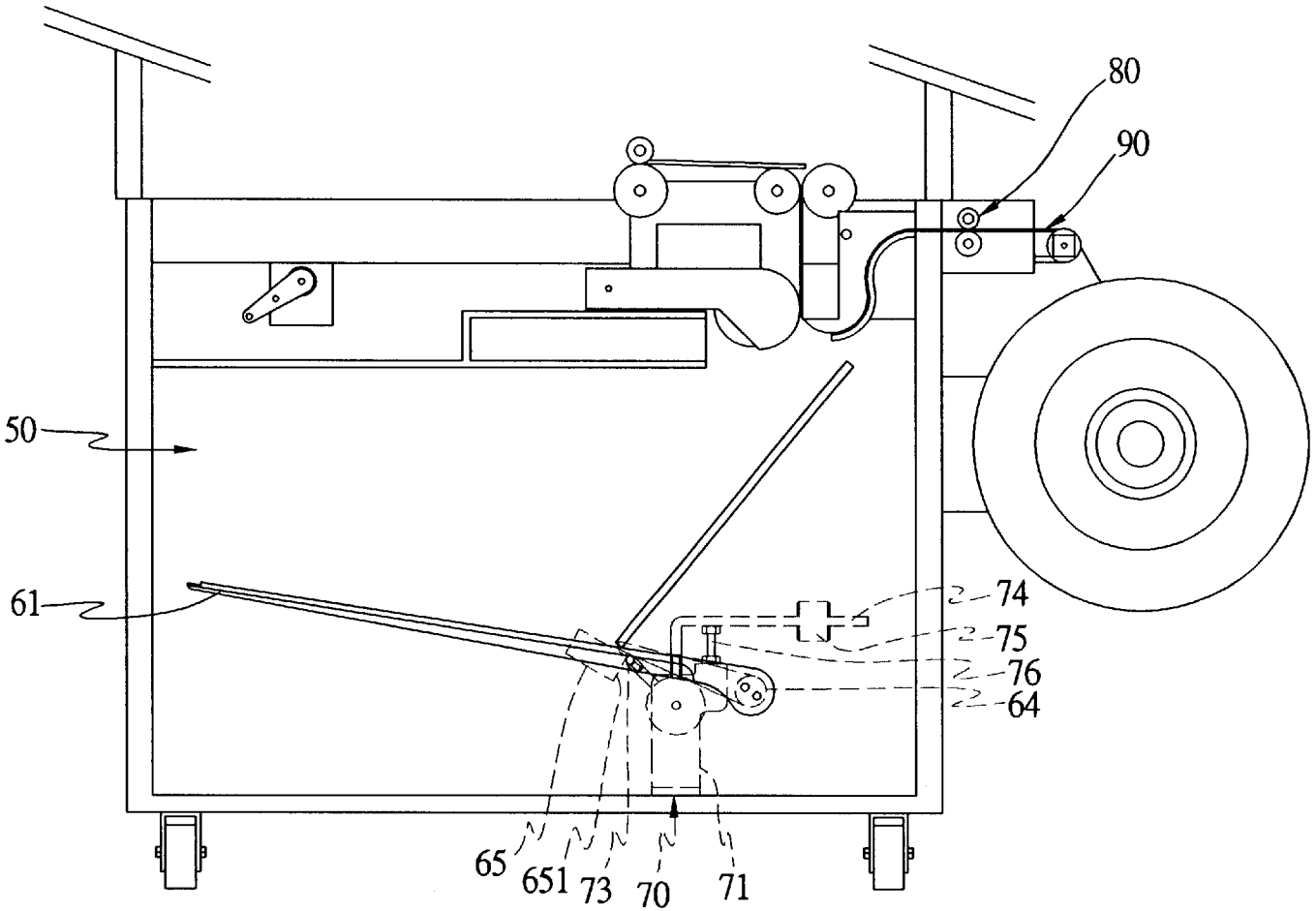
FIG. 8 is a cross-sectional view of the preferred embodiment of the rod-actuating strap control device before storing packaging strap in the strap reserving room in the present invention.

A preferred embodiment of a rod-actuating strap control device for a strapping machine in the present invention, as shown in FIGS. 6, 7 and 8, includes a strap reserving room 50 and a rod-actuating strap control device 60.

The strap reserving room 50 is made by connecting a separating plate 51 with a cover plate 52 at a preset interval. The separating plate 51 is bored at a right lower side with a through hole 511 having plural small holes 512 around the through hole 511.

The rod-actuating strap control device 60 consists of a balanced rod 61, a rotating shaft 62, a shaft sleeve 63, a press rod 64, a sensing switch 65 and a rod-interacting unit 70 combined together.

The balanced rod 61 is horizontally and sidewise fitted through the strap reserving room 50, having a proper length.

The rotating shaft 62 has its front end secured perpendicularly with one end of the balanced rod 61 and its rear end formed with a combining portion 621. The rotating shaft 62 is inserted through the through hole 511 of the separating plate 51 and extends outward.

The shaft sleeve 63 is shaped cylindrical, fixed threadably on the outer side of the separating plate 51 by means of four combining members 67 screwing through the small holes 512 of the separating plate 51. The shaft sleeve 63 is axially bored with a shaft hole 631 aligned to the through hole 511 for the rotating shaft 62 to be inserted therethrough, with the combining portion 621 of the rotating shaft 62 extending out of the shaft hole 631.

The press rod 64 has a lateral fit hole 641 at one end for engaging the combining portion 621 of the rotating shaft 62. The press rod 64 is fixed with the combining portion 621 by two combining members 67, having a preset length and positioned in the same direction as the balanced rod 61.

The sensing switch 65 is a proximity sensor in this preferred embodiment, positioned beside the press rod 64 and having a sensing portion 651 on a side surface for sensing.

The rod-interacting unit 70 consists of a base 71, a rotary member 72, an actuating rod 73, a weight rod 74, a weight member 75 and a position-limiting rod 76.

The base 71 is firmly assembled on the outer side of the separating plate 51, adjacent to the press rod 64. The base 71 has a bottom plate 711 extending horizontally to be fixed on the bottom of an inner lower side of the machine base of a strapping machine, an upright plate 712 extending upward vertically from the bottom plate 711, having a pivotal shaft 713 at a preset position of an upper inner side, and a top plate 714 extending horizontally from the top edge of the upright plate 712 and facing the separating plate 51.

The rotary member 72 is column-shaped, having a pivotal hole 721 in the center to be fitted around the pivotal shaft 713 of the upright plate 712 to let the rotary member 72 able to rotate thereon. Besides, the rotary member 72 is diametrically bored with an upper combining member 722 and a side combining member 723 spaced apart and respectively having a threaded hole, with the interval between the two combining portions 722, 723 formed with a contained angle of about 45 degrees.

The actuating rod 73 is L-Shaped, having a short portion 731 and a long portion 733. The short portion 731 is formed with a threaded combining member 732 screwing in the side combining member 723 of the rotary member 72, while the long portion 733 extends toward the separating plate 51 and pushes against the bottom edge at an inner front end of the press rod 64, having its end portion face the sensing portion 651 of the sensing switch 65 so as to enable the sensing portion 651 to sense the movement of the actuating rod 73.

The weight rod 74 is L-Shaped, having a short portion 741 and a long portion 743. The short portion 741 is formed with a threaded combining portion 742 screwed with the upper combining portion 722 of the rotary member 72, while the long rod 743 extends toward the press rod 64 to a preset length, parallel to the press rod 64 in an opposite direction. Thus, an interacting structure of a reverse action, with the rotary member 72 acting as a rotating fulcrum, is formed between the weight rod 74 and the actuating rod 73.

The weight-matching member 75 has a lengthwise fit hole 751 for the weight rod 74 to be inserted therethrough and a diametrical screw hole 752 communicating with the fit hole 751, with a bolt 753 positioned in the screw hole 752 for fixing the weight-matching member 75 on the weight rod 74.

The position-limiting rod 76 is vertically disposed on the top plate 714 of the base 71, having its top edge push against the bottom edge of the long portion 743 of the weight rod 74 for controlling both the weight rod 74 and the actuating rod 73 to be normally positioned in a preset balanced condition.

Figure 9:
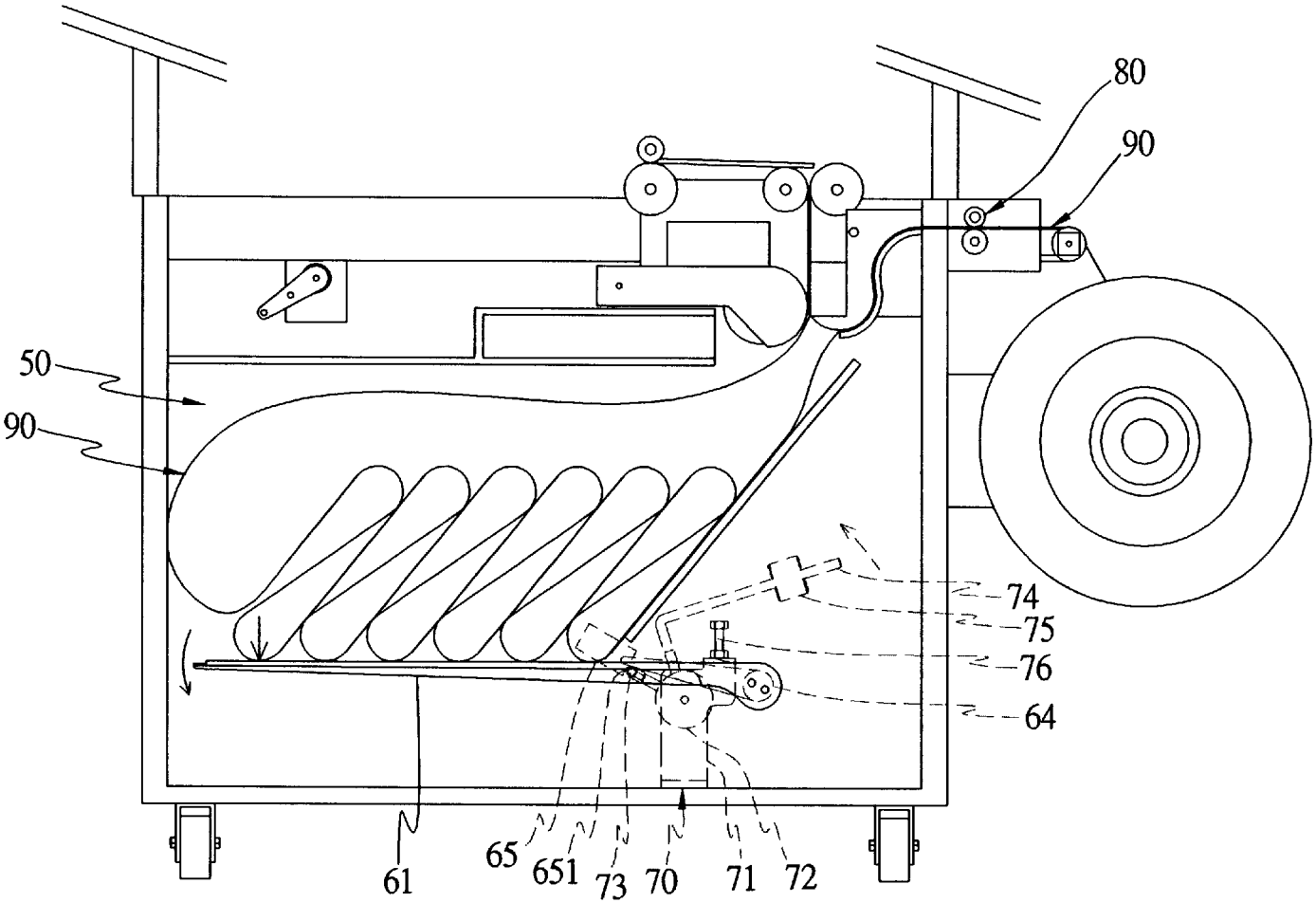
FIG. 9 is a cross-sectional view of the preferred embodiment of the rod-actuating strap control device after storing packaging strap in the strap reserving room in the present invention.
Figure 10:
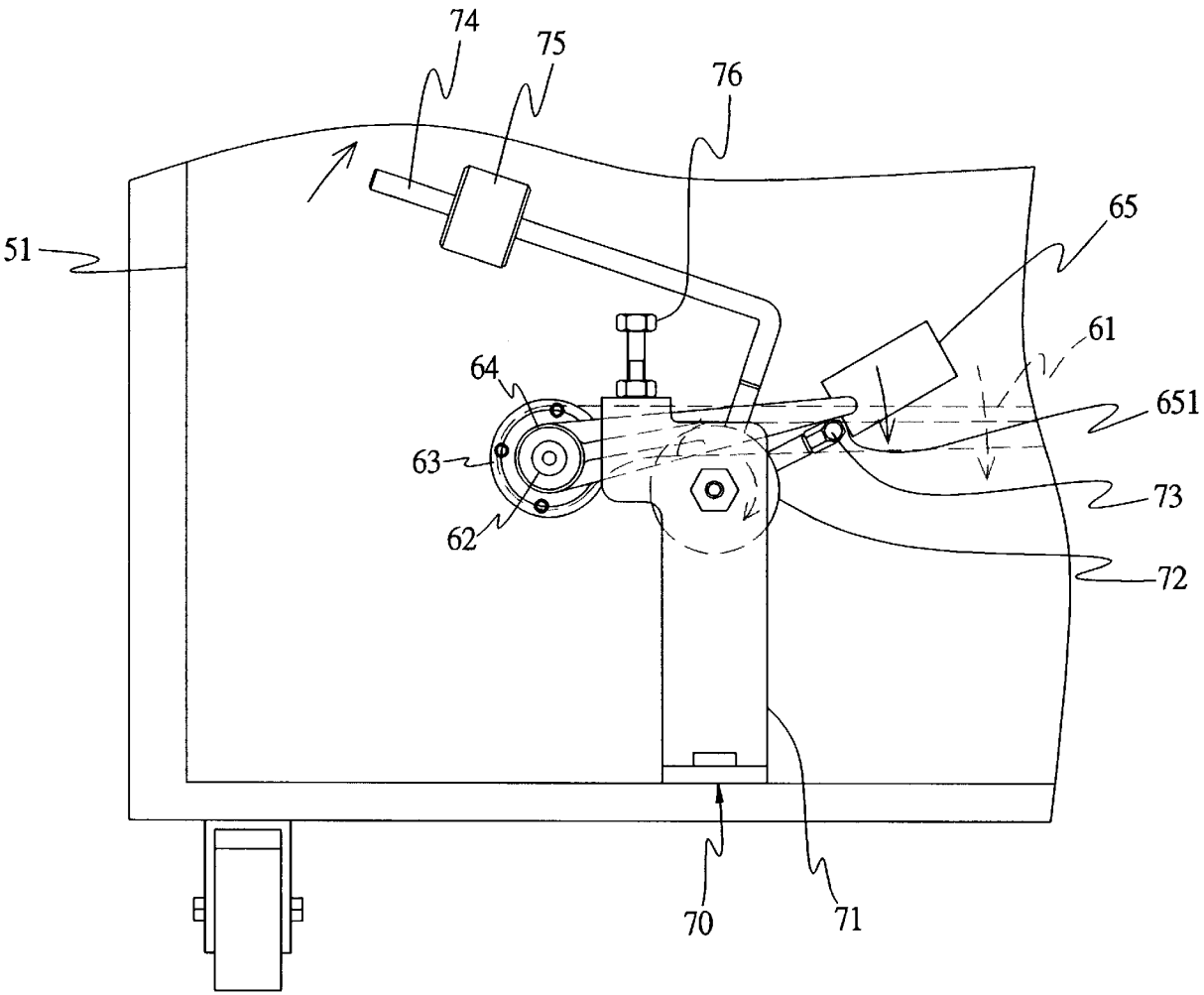
FIG. 10 is a cross-sectional view of the preferred embodiment of an operating condition of a sensing rod, an actuating rod and a weight-matching rod after storing packaging strap in the strap reserving room in the present invention.

In operation, as shown in FIGS. 7, 9 and 10, firstly, start the strap feed device 80 to guide a packaging strap 90 orderly into the strap reserving room 50. When the action of weight of the packaging strap 90 stored in the strap reserving room 50 is larger than the weight of the weight member 75 of the rod-interacting unit 70, the balanced rod 61 will be pressed by the packaging strap 90 to incline downward and actuate the rotating shaft 62 to rotate and force the press rod 64 to incline downward d synchronously. And when actuated to incline downward, the press rod 64 will press the actuating rod 73 to incline down to make the rotary member 72 rotate and actuate the weight rod 74 to incline upward in an opposite direction.

When the press rod 64 is forced to incline downward, its end portion will reach a position facing the sensing portion 651 of the sensing switch 65, and when the sensing portion 651 senses it, the sensing switch 65 will immediately send a signal out to turn off the power of the strap feed device 80 to stop guiding the packaging strap 90 into the strap reserving room 50, thus finish work of a round of strap reserving.

On the contrary, referring to FIGS. 8 and 9, in case the packaging strap 90 in the strap reserving room 50 is guided out for strapping an article, the weight of the packaging strap 90 pressing on the balanced rod 61 will vanish, the weight rod 74 will automatically recover its original position by the weight of the weight member 75, and the actuating rod 73, the press rod 64 as well as the balanced rod 61 will return back to their original locations by the interaction of the rotary member 72 and the rotating shaft 62. Under this condition, the end portion of the press rod 64 separates from the sensing portion 651 and the signal sensed by the sensing portion 651 is interrupted, and on receiving this interrupted signal, the sensing switch 65 will instantly turn on the power of strap feed device 80 to enable the strap feed device 80 to guide the packaging strap 90 into the strap reserving room 50 for a next round of storing a strap 90.

Figure 11:
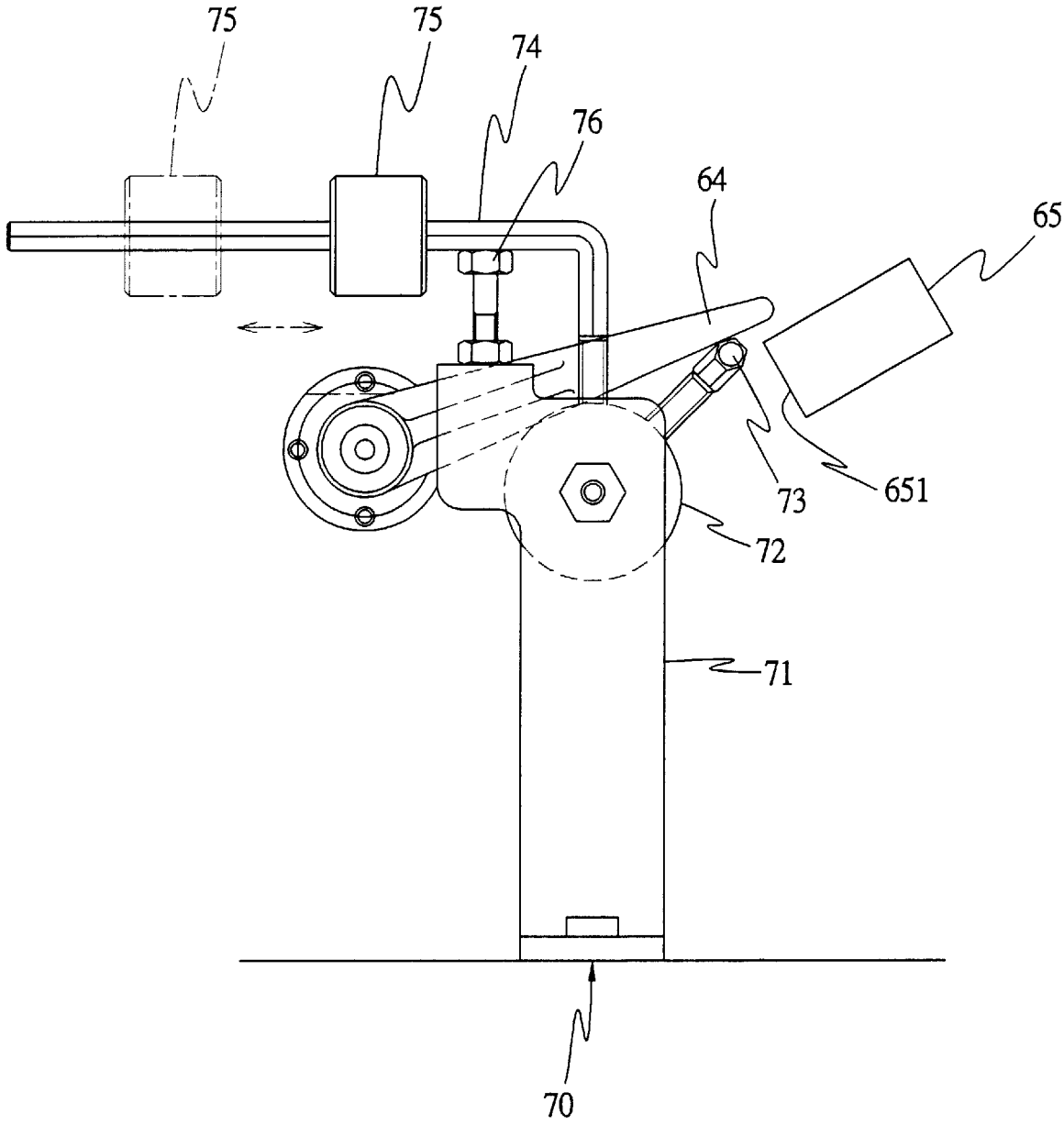
FIG. 11 is cross-sectional view of the preferred embodiment of a weight member having its position adjusted on the weight rod in the present invention.

In addition, the weight member 75 can be freely adjusted in, its position on the weight-matching rod 74, as shown in FIG. 11. In case the weight member 75 is located relatively close to the rotary member 72, the distance of its arm of force to the rotating fulcrum is relatively short, and hence its relative weight to the actuating rod 73, to the press rod 64 and to the balanced rod 61 becomes small, and as a result, the length or amount of the packaging strap 90 stored in the strap reserving room 50 become short and small. Contrarily, if the weight member 75 is positioned comparatively far from the rotary member 72, the distance of its arm of force to the rotating fulcrum is comparatively long and its relative weight to the actuating rod 73, to the press rod 64 and to the balanced rod 61 becomes large and so the length or amount of the packaging strap 90 stored in the strap reserving room 50 become long and large. Thus, adjusting the position of the weight-matching member 75 on the weight-matching rod 74 can make the length or amount of the packaging strap stored in the strap reserving room 50 reach an ideal condition conforming to practical use, regardless of the size of an article to be strapped.

Evidently, this invention has some advantages described below.

1. The relative action produced between the rod-interacting unit and the balanced rod with cooperation of the sensing function of the sensing switch and the actuating rod can effectively control the length or amount of the packaging strap stored in the strap reserving room.

2. A lever structure is utilized between the weight rod and the actuating rod of the rod-interacting unit, with the actuating rod pushing against the press rod as well as the balanced rod, therefore no tiredness of resilience or damage of a twisting spring may happen, able to prolong the service life of the machine, lower cost of maintenance and control the length or amount of packaging strap stored in the strap reserving room with great precision and stability.

While the preferred embodiment of the invention has been described above, it will be recognized and understood that various modifications may be made therein and the appended claims are intended to cover all such modifications that may fall within the spirit and scope of the invention.

What is claimed is:

1. A rod-actuating strap control device for a strapping machine comprising:

a strap reserving room formed by connecting a separating plate with a cover plate at a preset interval;

a balanced rod positioned horizontally on the bottom of said strap reserving room;

a rotating shaft fixed perpendicularly at one end of said balanced rod, said rotating shaft inserted through a through hole of said separating plate, said rotating shaft formed with a combining portion at an outer end;

a shaft sleeve secured on the outer side of said through hole of said separating plate, said shaft sleeve bored axially with a shaft hole for said rotating shaft inserted therethrough;

a press rod having a lateral fit hole in one end, said press rod engaging with said combining portion of said rotating shaft;

a sensing switch having a sensing portion on a side surface and positioned beside said press rod; and a rod-interacting unit positioned at the outer side of said separating plate, adjacent to said press rod, said rod-interacting unit comprising a base, a rotary member, an actuating rod, a weight rod, a weight-matching member and a position-limiting rod;

said base fixed at the outer side of said separating plate, adjacent to said press rod, said base having a bottom plate extending horizontally, said bottom plate secured on the inner bottom part of said strapping machine, said base having an upright plate vertically extending upward from said bottom plate, said upright plate provided with a pivotal shaft at a preset position at the upper inner side, said upright plate having a top plate extending horizontally from a top side toward said separating plate;

said rotary member column-shaped and bored axially with a pivotal hole in the center, said pivotal hole fitted around said pivotal shaft of said upright plate, said rotary member able to rotate around said pivotal shaft, said rotary member provided diametrically with two combining members, said two combining members positioned spaced apart and maintaining therebetween an interval of a preset contained angle;

said actuating rod being L-shaped and including a short portion and a long portion, said short portion having a combining member, said combining member of said short portion of said actuating rod screwing with one of said two combining members of said rotary member, said long portion extending toward said separating plate and pushing against the inner bottom surface of the front end of said press rod, said long portion having its end facing said sensing portion of said sensing switch, said sensing portion sensing the movement of said actuating rod, said sensing switch sending out a signal for controlling a strap feed device to start or stop operation;

said weight rod being, L-Shaped, said weight rod consisting of a short portion and a long portion, said short portion having a combining member, said combining member of said short portion of said weight rod engaging the other of said two combining members of said rotary member, said long portion extending toward said press rod and positioned parallel to said press rod in an opposite direction, between said weight rod and said actuating rod formed an interacting structure of a reverse action, with said rotary member acting as a rotating fulcrum;

said weight matching member able to be disposed at one of many locations on said weight rod; and said position-limiting rod vertically positioned on said top plate of said base, said position-limiting rod having its top edge pushing against the bottom edge of said long rod of said weight rod, said position-limiting rod controlling said weight rod and said actuating rod at a preset balanced position normally.

2. The rod-actuating control device for a strapping machine as claimed in claim 1, wherein said sensing switch is a proximity sensor, having a sensing portion on one side facing said actuating rod.

3. The rod-actuating control device for a strapping machine as claimed in claim 1, wherein said combining members of said rotary member are screw holes, while aid combining member of said actuating rod and said weight rod is threads.

4. The rod-actuating control device for a strapping machine as claimed in claim 1, wherein said weight matching member is bored with a fit hole for said weight rod inserted therethrough, and a screw hole diametrically communicating with said fit hole, with a bolt screwing in said screw hole for adjusting and fixing said weight matching member on said weight rod.

* * * * *